US006719295B2

(12) United States Patent
Mohammed-Fakir et al.

(10) Patent No.: US 6,719,295 B2
(45) Date of Patent: Apr. 13, 2004

(54) SUPPLEMENTAL SEAL FOR THE CHORDAL HINGE SEALS IN A GAS TURBINE

(75) Inventors: Abdul-Azeez Mohammed-Fakir, Schenectady, NY (US); Mahmut Faruk Aksit, Istanbul (TR); Ahmad Safi, Troy, NY (US); Srikanth Vedantam, Niskayuna, NY (US); Ning Fang, West Chester, OH (US)

(73) Assignee: General Electric Company, Schenectady, NY (US)

( * ) Notice: Subject to any disclaimer, the term of this patent is extended or adjusted under 35 U.S.C. 154(b) by 180 days.

(21) Appl. No.: 10/029,226

(22) Filed: Dec. 28, 2001

(65) Prior Publication Data

US 2003/0122310 A1 Jul. 3, 2003

(51) Int. Cl.[7] ..... F16J 15/44

(52) U.S. Cl. ..... 277/411; 277/586; 277/627; 277/630

(58) Field of Search ..... 277/411, 586, 277/602, 608, 627, 630, 650, 654

(56) References Cited

U.S. PATENT DOCUMENTS

| | | | | | |
|---|---|---|---|---|---|
| 4,576,081 | A | * | 3/1986 | Felthuis et al. | 87/6 |
| 5,014,917 | A | * | 5/1991 | Sirocky et al. | 239/265.11 |
| 5,301,595 | A | * | 4/1994 | Kessie | 87/6 |
| 5,358,262 | A | * | 10/1994 | Roberts | 277/652 |
| 5,370,405 | A | * | 12/1994 | Ueda | 277/537 |
| 6,446,979 | B1 | * | 9/2002 | Steinetz et al. | 277/630 |

* cited by examiner

*Primary Examiner*—Anthony Knight
*Assistant Examiner*—E Peavey
(74) *Attorney, Agent, or Firm*—Nixon & Vanderhye, P. C.; Richard C. Besha

(57) ABSTRACT

In a gas turbine having a chordal hinge seal between an inner rail of each nozzle segment and an annular axially facing sealing surface of a nozzle support ring, a supplemental seal is disposed between the support ring and inner rail of the nozzle segment on a lower pressure side of the chordal hinge seal. The supplemental seal comprises a segmented annular composite tubular woven compliant seal disposed in a cavity along a sealing surface of the inner rail of the segment. The seal bears against the annular sealing surface of the nozzle support ring, which compresses the seal. Because of the compliant nature of the seal, a supplemental seal is formed on the low pressure side of the chordal hinge seal.

13 Claims, 7 Drawing Sheets

SUPPLEMENTAL SEAL FOR THE CHORDAL HINGE SEALS IN A GAS TURBINE

BACKGROUND OF THE INVENTION

The present invention relates to seals in a gas turbine for supplementing the chordal hinge seals between turbine nozzles and a turbine nozzle support ring and particularly relates to supplementary seals for substantially minimizing or eliminating leakage losses past the chordal hinge seals.

In a gas turbine, hot gases of combustion flow from combustors through first-stage nozzles and buckets and through the nozzles and buckets of follow-on turbine stages. The first-stage nozzles typically include an annular array or assemblage of cast nozzle segments each containing one or more nozzle stator vanes per segment. Each first-stage nozzle segment also includes inner and outer band portions spaced radially from one another. Upon assembly of the nozzle segments, the stator vanes are circumferentially spaced from one another to form an annular array thereof between annular inner and outer bands. A nozzle retaining ring coupled to the outer band of the first-stage nozzles supports the first-stage nozzles in the gas flow path of the turbine. An annular nozzle support ring, preferably split at a horizontal midline, is engaged by the inner band and supports the first-stage nozzles against axial movement.

In an exemplary arrangement, eighteen cast segments are provided with two vanes per segment. The annular array of segments are sealed one to the other along adjoining circumferential edges by side seals. The side seals seal between a high pressure region radially inwardly of the inner band, i.e., compressor discharge air at high pressure, and the hot gases of combustion in the hot gas flow path which are at a lower pressure.

Chordal hinge seals are used to seal between the inner band of the first-stage nozzles and an axially facing surface of the nozzle support ring. Each chordal hinge seal includes an axial projection which extends linearly along a chord line of the inner band portion of each nozzle segment. Particularly, the chordal hinge seal extends along an inner rail of each segment and which rail extends radially inwardly of the inner band portion. The chordal hinge seal projection lies in sealing engagement with the axially opposite facing sealing surface of the nozzle support ring.

During operation and/or repair of the first-stage nozzle, it has been found that warpage can leave gaps between the chordal hinge seals and the sealing surface of the nozzle support ring. These gaps enable leakage past the chordal hinge seals from the high pressure area radially within the annular inner band into the hot gas flow path. That is, the chordal hinge seals are inadequate to prevent leakage flow as the chordal hinge seal projections lose contact with the sealing surface of the nozzle support ring. Consequently, there is a need for a supplemental seal at the interface of the first-stage nozzles and nozzle support ring to minimize or eliminate the leakage flow past the chordal hinge seals.

BRIEF DESCRIPTION OF THE INVENTION

In accordance with a preferred embodiment of the present invention, there is provided a supplemental seal between the first-stage nozzles and the nozzle support ring which eliminates or minimizes leakage past the chordal hinge seals and which is readily and easily installed. The supplemental seal hereof includes a composite, preferably tubular woven seal for sealing between the nozzle segments and the nozzle support ring. More particularly, the inner rail of each nozzle segment is provided with an arcuate cavity radially outwardly of the chordal hinge seal. The composite tubular woven seal is disposed in the cavity and bears against the annular sealing surface of the nozzle support ring. That is, when the chordal hinge engages the sealing surface of the nozzle support ring, the composite tubular woven seal is resiliently flattened between the first and second sealing surfaces of the nozzle support ring and the inner rail, respectively, to seal between those surfaces. Thus, in the event of axial warpage/deformation of the chordal hinge seal, the composite tubular woven seal expands to fill the gap.

The composite tubular woven supplemental seal is compliant as a result of the multiple layers forming the seal. The layers include an inner woven metal core, a fiber material, a metallic foil and a metal outer covering. Preferably, the inner metal core is formed of a woven stainless steel which is surrounded by a silica fiber. The fiber, in turn, is surrounded by a stainless steel metal foil and the outer covering is formed of a braided metal, for example, Haynes 188. Because of the nature of the composite tubular woven seal, the seal is compliant, particularly as a result of the resiliency of the metal core and surrounding silica fiber. Moreover, the metal foil layer surrounding the fiber prevents leakage between the supplemental seal and the sealing surface of the nozzle support ring, while the braided outer covering serves as a protective wear surface. The inner metal core and silica fibers retain the generally circular configuration of the supplemental seal in cross-section such that the seal, when compressed, is preloaded or biased for return to its circular cross-sectional configuration. In this manner, any leakage flow past the chordal hinge seal is sealed by the supplemental seal.

In a preferred embodiment according to the present invention, there is provided a turbine comprising a turbine nozzle support ring having a generally axially facing first surface, a turbine nozzle segment having at least one stator vane and including an inner band having a second surface in axial opposition to the first surface, a cavity in one support ring and a portion of the inner band of the segment, the cavity opening generally in an axial direction and toward another of the support ring and the inner band portion and a compliant seal in the cavity including a seal body formed of multiple layers of different materials for compliantly engaging against one of the first and second surfaces opposite the cavity to seal thereagainst.

In a further preferred embodiment according to the present invention, there is provided a gas turbine comprising a turbine nozzle support ring having a generally axially facing annular first surface, a plurality of turbine nozzle segments defining an annular array of stator vanes and an annular second surface in axial opposition to the first surface, each segment including an axially extending projection along a portion of the second surface for engagement with the first surface of the support ring to form a first seal therebetween for sealing between high and low pressure regions on opposite sides of the first seal, an annular cavity in one of the first and second surfaces radially outwardly of the first seal, the cavity opening generally in an axial direction and toward another of the first and second surfaces and a compliant seal in the cavity including a seal body formed of multiple layers of different materials for compliantly engaging against another of the first and second surfaces opposite the cavity to seal thereagainst.

DETAILED DESCRIPTION OF THE INVENTION

Figure 1:
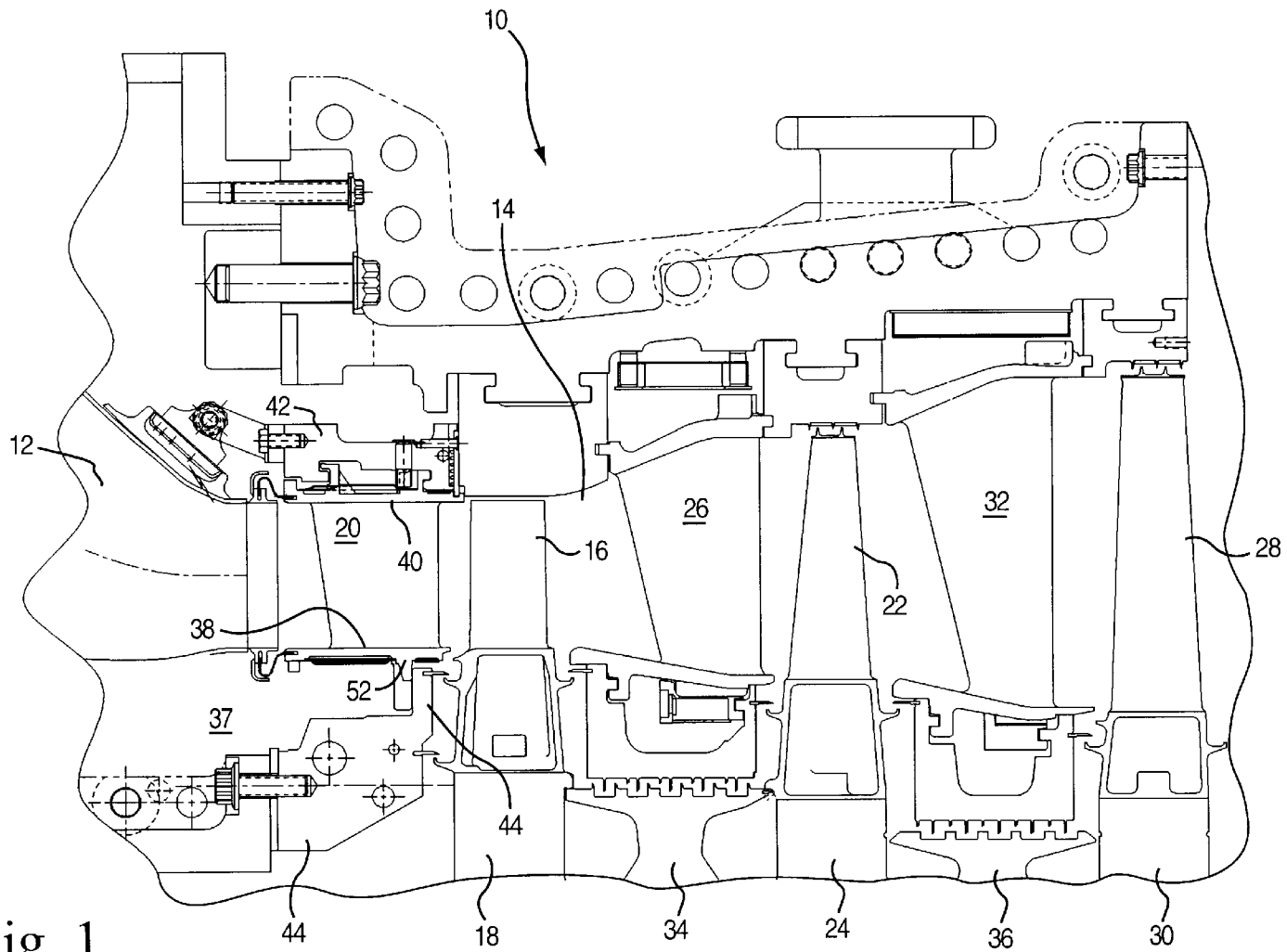
Fig. 1 (Prior Art)
FIG. 1 is a fragmentary schematic side elevational view of a portion of a gas turbine.

Referring now to FIG. 1, there is illustrated a representative example of a turbine section of a gas turbine, generally designated 10. Turbine 10 receives hot gases of combustion from an annular array of combustors, not shown, which transmit the hot gases through a transition piece 12 for flow along an annular hot gas path 14. Turbine stages are disposed along the hot gas path 14. Each stage comprises a plurality of circumferentially spaced buckets mounted on and forming part of the turbine rotor and a plurality of circumferentially spaced stator vanes forming an annular array of nozzles. For example, the first stage includes a plurality of circumferentially-spaced buckets 16 mounted on a first-stage rotor wheel 18 and a plurality of circumferentially-spaced stator vanes 20. Similarly, the second stage includes a plurality of buckets 22 mounted on a rotor wheel 24 and a plurality of circumferentially-spaced stator vanes 26. Additional stages may be provided, for example, a third stage comprised of a plurality of circumferentially-spaced buckets 28 mounted on a third-stage rotor wheel 30 and a plurality of circumferentially-spaced stator vanes 32. It will be appreciated that the stator vanes 20, 26 and 32 are mounted on and fixed to a turbine casing, while the buckets 16, 22 and 28 and wheels 18, 24 and 30 form part of the turbine rotor. Between the rotor wheels are spacers 34 and 36 which also form part of the turbine rotor. It will be appreciated that compressor discharge air is located in a region 37 disposed radially inwardly of the first stage and that such air in region 37 is at a higher pressure than the pressure of the hot gases flowing along the hot gas path 14.

Figure 2:
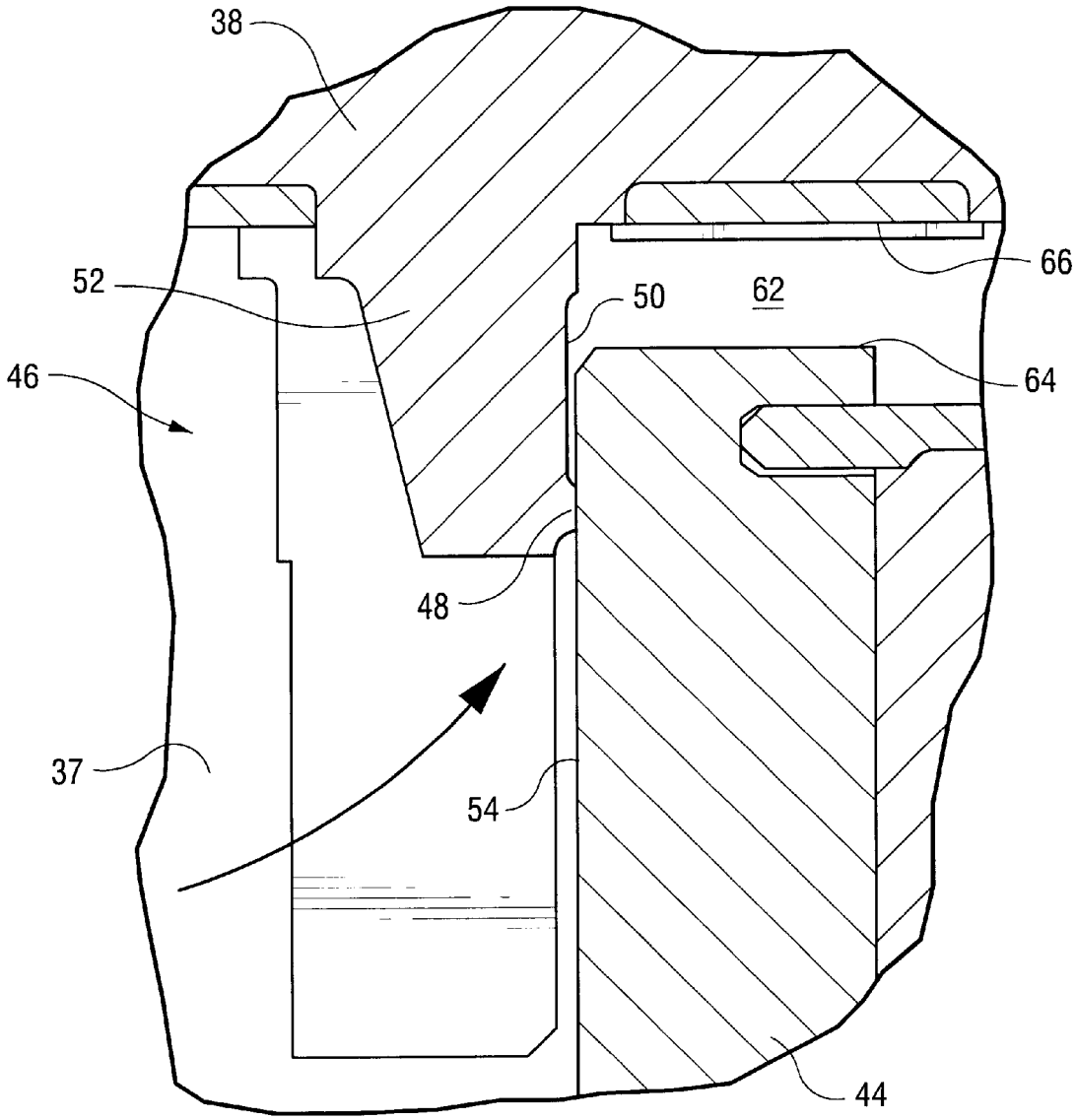
Fig. 2 (Prior Art)
FIG. 2 is an enlarged fragmentary cross-sectional view illustrating a conventional chordal seal hinge.
Figure 3:
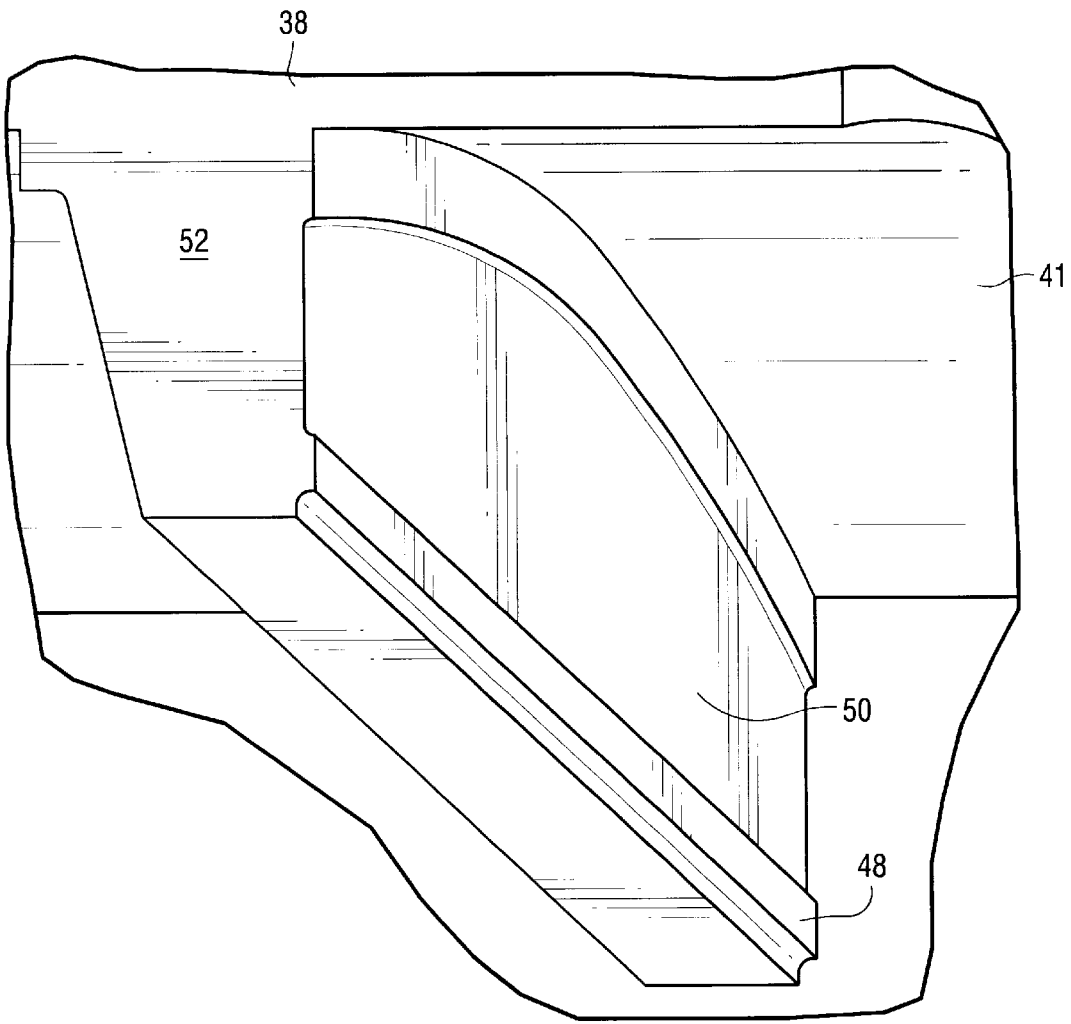
Fig. 3 (Prior Art)
FIG. 3 is a fragmentary perspective view illustrating a portion of a conventional chordal hinge seal along an inner rail of a nozzle segment.
Figure 4:
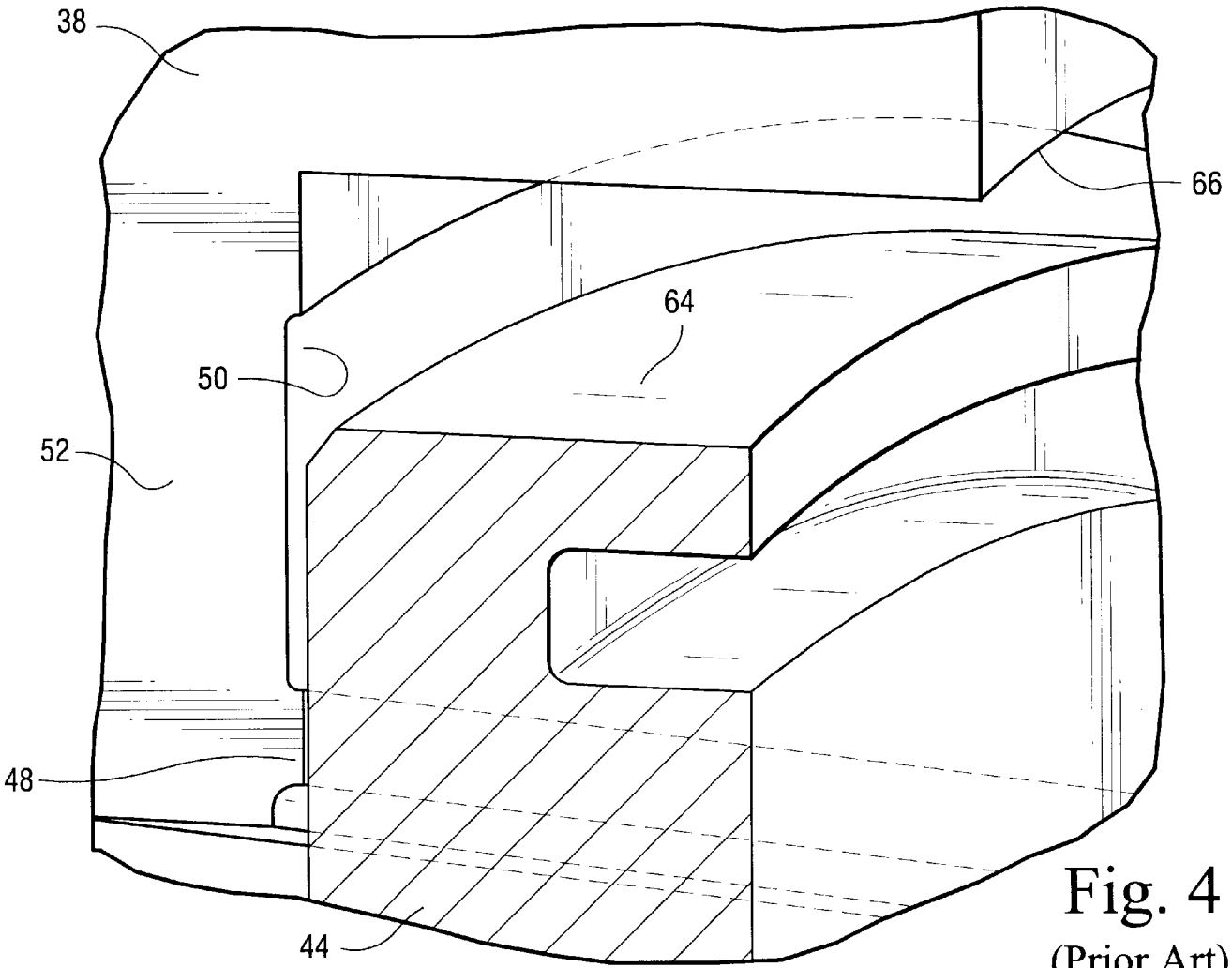
Fig. 4 (Prior Art)
FIG. 4 is a fragmentary perspective view with parts in cross-section illustrating the conventional chordal hinge seal in sealing engagement with a nozzle support ring of the gas turbine.

Referring to the first stage of the turbine, the stator vanes 20 forming the first-stage nozzles are disposed between inner and outer bands 38 and 40, respectively, supported from the turbine casing. As noted above, the nozzles of the first stage are formed of a plurality of nozzle segments 41 (FIG. 3) each mounting one, preferably two, stator vanes extending between inner and outer band portions and arranged in an annular array of segments. A nozzle retaining ring 42 connected to the turbine casing is coupled to the outer band and secures the first-stage nozzle. A nozzle support ring 44 radially inwardly of the inner band 38 of the first-stage nozzles engages the inner band 38. Particularly, the interface between the inner band 38 and the nozzle support ring 44 includes an inner rail 52 (FIG. 2). The inner rail 52 includes a chord-wise, linearly extending axial projection 48, generally and collectively hereinafter referred to as a chordal hinge seal 46. Projection 48 extends along an axial facing surface 50 of the inner rail 52 which forms an integral part of each nozzle segment and specifically the inner band 38. The projection 48 engages a first annular surface 54 of the nozzle support ring 44. It will be appreciated that high pressure compressor discharge air lies in the region 37 and lower pressure hot gases flowing in the hot gas path 14 lie on the opposite side of the seal 48. The chordal hinge seal 46 thus is intended to seal against leakage from the high pressure region 37 into the lower pressure region of the hot gas path 14.

Figure 5:
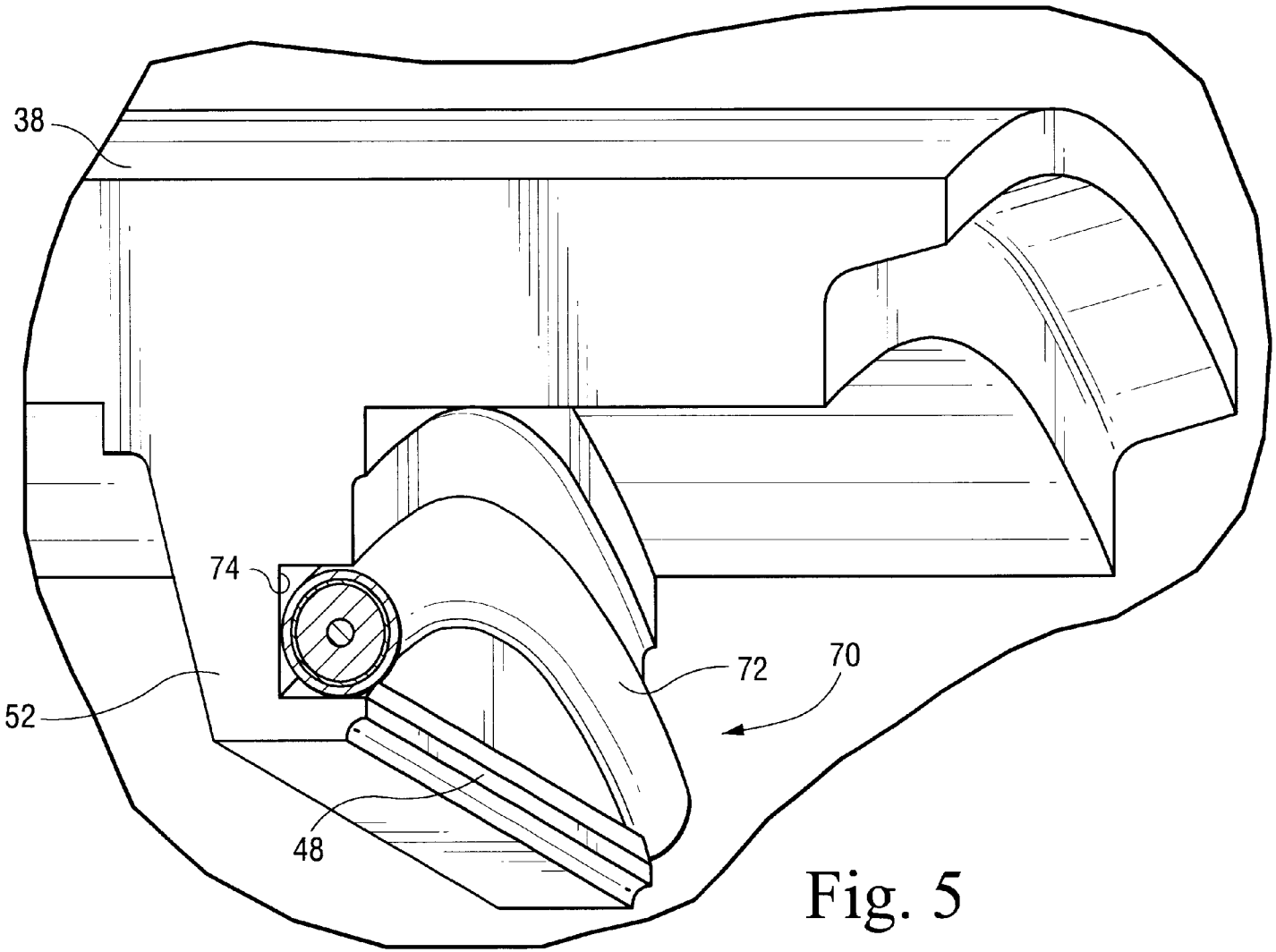
FIG. 5 is a fragmentary perspective view of the inner band and inner rail of a nozzle segment illustrating the chordal hinge seal and supplemental seal hereof.

As noted previously, however, and in turbine operation, component parts of the nozzles and nozzle support ring will tend to form leakage gaps between the projection 48 and the surface 54 of the nozzle support ring 44 whereby leakage flow may occur from the high pressure region 37 to the low pressure region 14. In order to minimize or prevent leakage flow into the hot gas path 14, and in accordance with a preferred embodiment of the present invention, there is provided a supplemental seal for sealing between the first-stage nozzles and the nozzle support ring 44. Referring to FIG. 5, the supplemental seal, generally indicated 70, includes a compliant seal body 72 disposed in a cavity 74, preferably formed in the inner rail 52 of the nozzle segment. While the projection 48 of the chordal hinge seal 46 extends in a chord-wise direction, the cavity 74 is formed along the surface 50 of the inner rail 52 in an arcuate configuration about the axis of the turbine rotor.

Figure 6:
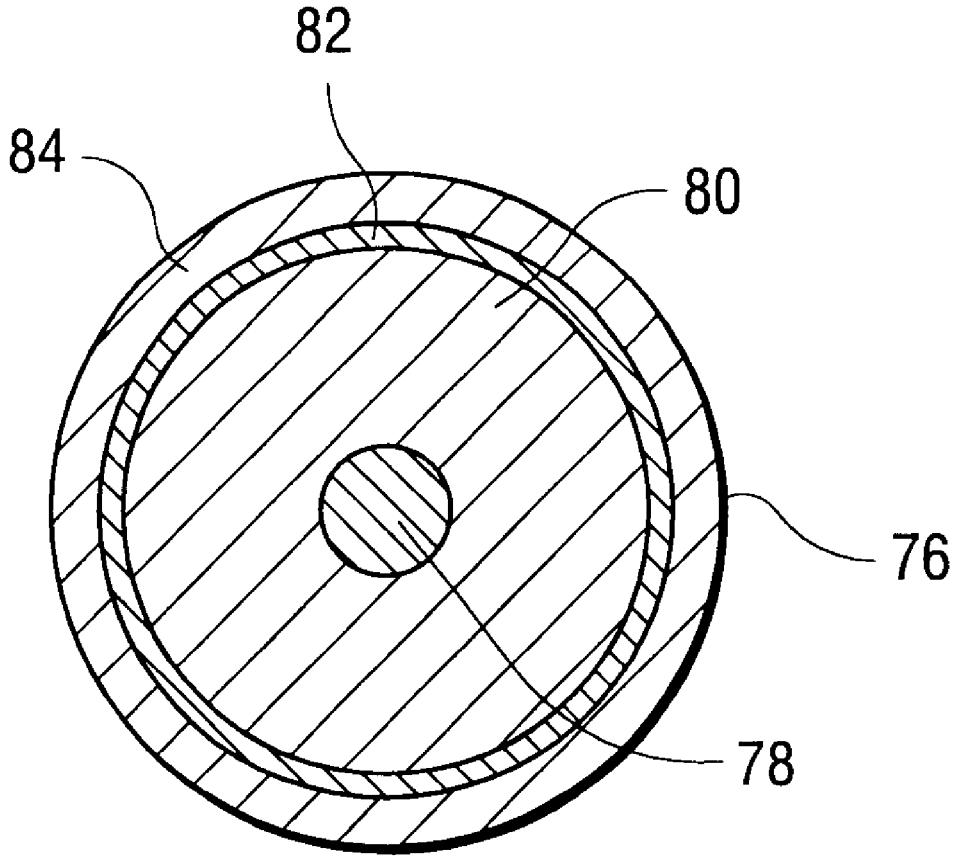
FIG. 6 is a cross-sectional view of the supplemental seal.

The seal body 72 preferably comprises a solid ring 76 which, in an uncompressed condition, has a circular cross-section, as illustrated in FIG. 6. The seal body ring 76 is formed of multiple layers of material. Preferably, the innermost layer 78 comprises a woven metal core 78 formed of a stainless steel material. Surrounding the metal core 78 is an annular layer of fiber, preferably a silica fiber 80. Surrounding the silica fiber 80 is a metal foil 82, preferably formed of stainless steel. Finally, the outer covering for the seal body 70 includes a metallic braided material, preferably a braided steel material such as Haynes 188. The composite tubular woven seal 70 is compliant in a lateral direction, i.e., is biased or preloaded to return to its circular cross-sectional shape in the event of compression.

Figure 7:
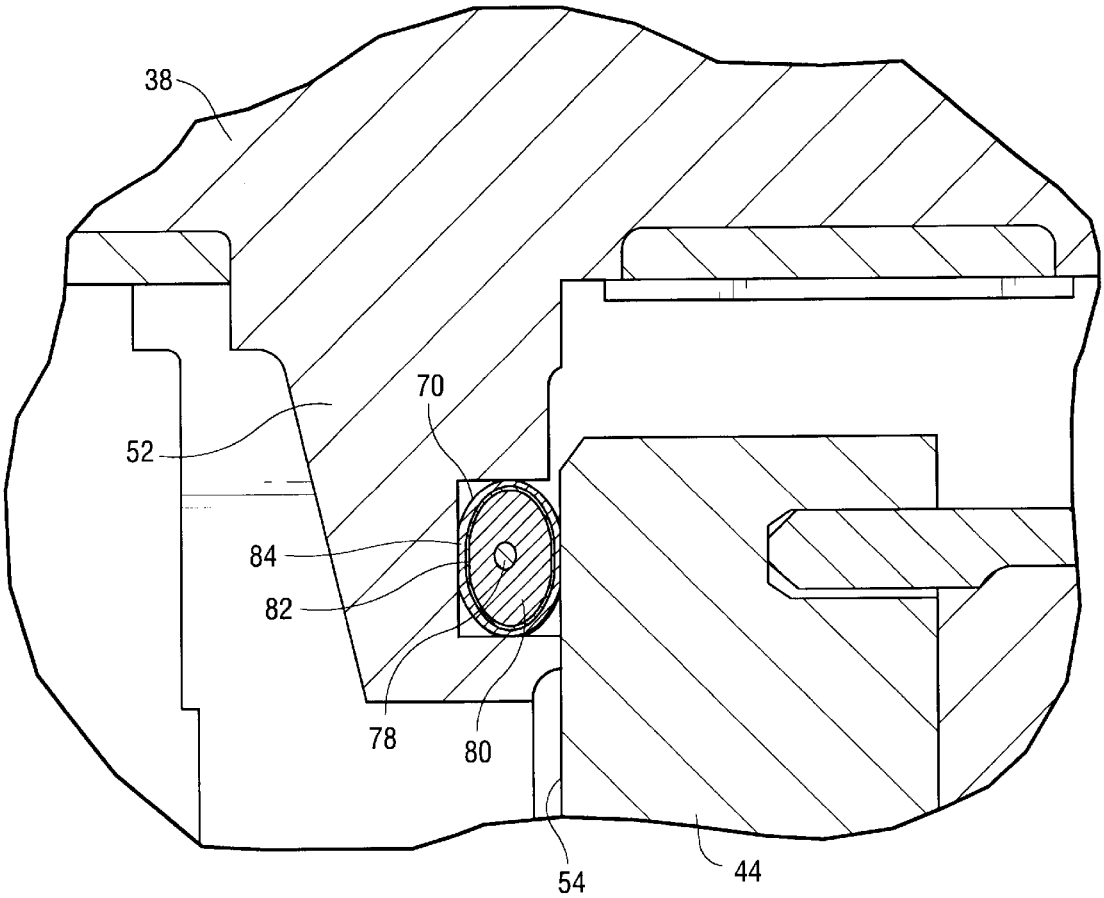
FIG. 7 is an enlarged fragmentary cross-sectional view illustrating the supplemental seal installed in the turbine sealing between the nozzle segment and the nozzle support ring.

As illustrated in both FIGS. 5 and 7, the cavity 74 has a width corresponding generally to the diameter of the seal body 70. However, the depth of the cavity is short of or less than the diameter of the seal body. Consequently, upon installation of the seal body 70 into cavity 74, the composite tubular woven seal is compliantly crushed between the base of the cavity 74 and the first surface 54 of the nozzle support ring 44. Consequently, in the event of any warpage or deformation of the chordal hinge seal, the composite tubular woven seal 70 expands to form a seal between the axially opposite surfaces due to its compliant nature. The woven metallic core 78 in combination with the heat-resistant silica layer enables the seal body 70 to tend to return to its circular configuration in cross-section. The metal foil layer 82 prevents leakage past the supplemental seal 70. The wear resistant outer braiding serves as a protective covering and wear surface.

It will be appreciated that the supplemental seal 70 can be provided in circumferential lengths in excess of the circumferential extent of each of the nozzle segments 41 and, hence, span the joints between adjacent segments. Preferably, the seal body 72 is provided in 90° or 180° lengths. Note that the supplemental seal 70 is on the low pressure side of the chordal hinge seal 46. Consequently, any leakage past the chordal hinge seal from the high pressure side 36 will be prevented from flowing to the low pressure region of the hot gas path.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a turbine nozzle support ring having a generally axially facing first surface;

a turbine nozzle segment having at least one stator vane and including an inner band having a second surface in axial opposition to said first surface;

a cavity in one of said support ring and a portion of said inner band of said segment, said cavity opening generally in an axial direction and toward another of said support ring and said inner band portion; and a compliant seal in said cavity including a seal body formed of multiple layers of different materials for compliantly engaging against one of said first and second surfaces opposite said cavity to seal thereagainst;

said materials of said seal body including a woven metal core, a fiber, a metallic foil and a protective metal layer.

2. A turbine according to claim 1 wherein said cavity and said seal body are arcuate in a circumferential direction about an axis of the turbine.

3. A gas turbine according to claim 1 wherein said woven metal core includes an inner core, said fiber being formed of silica, and said protective layer including an outer layer formed of a braided metal.

4. A turbine according to claim 1 wherein said cavity is formed in said second surface, said seal body compliantly engaging said first surface.

5. A turbine according to claim 1 wherein said segment includes an axially extending projection along said second surface thereof for engagement with said first surface of said support ring to form another seal therebetween for sealing between high and low pressure regions on opposite sides of said another seal, said compliant seal being located on a low pressure side of said another seal.

6. A turbine according to claim 5 wherein the projection of said another seal extends along a chord of the segment about a turbine axis.

7. A turbine according to claim 6 wherein said cavity is formed in said second surface, said seal body compliantly engaging said first surface.

8. A gas turbine comprising:

a turbine nozzle support ring having a generally axially facing annular first surface;

a plurality of turbine nozzle segments defining an annular array of stator vanes and an annular second surface in axial opposition to said first surface;

each said segment including an axially extending projection along a portion of said second surface for engagement with said first surface of said support ring to form a first seal therebetween for sealing between high and low pressure regions on opposite sides of said first seal;

an annular cavity in one of said first and second surfaces radially outwardly of said first seal, said cavity opening generally in an axial direction and toward another of said first and second surfaces; and a compliant seal in said cavity including a seal body formed of multiple layers of different materials for compliantly engaging against said another of said first and second surfaces opposite said cavity to seal thereagainst;

said materials of said seal body comprising a woven metal core, a fiber, a metallic foil and a protective metal layer.

9. A gas turbine according to claim 8 wherein said woven metal core includes an inner core, said fiber being formed of silica, and said protective layer including an outer layer formed of a braided metal.

10. A gas turbine according to claim 8 wherein said cavity is formed in said second surface, said seal body compliantly engaging said first surface.

11. A gas turbine according to claim 8 wherein the projection of said first seal extends along a chord of each segment about a turbine axis.

12. A gas turbine according to claim 8 wherein said cavity is formed in said second surface, said seal body compliantly engaging said first surface, said fiber comprising a silica fiber surrounding said core, said metallic foil surrounding said silica fiber and said protective layer comprising an outer braided metal layer.

13. A gas turbine according to claim 8 wherein each of said nozzle segments has a circumferential extent between opposite sides thereof, said compliant seal having a circumferential extent in excess of the circumferential extent of said nozzle segments to span the joint between adjacent nozzle segments.

* * * * *